US011522263B1

(12) United States Patent
Xu et al.

(10) Patent No.: US 11,522,263 B1
(45) Date of Patent: Dec. 6, 2022

(54) BALANCED-TYPE STRIP-SHAPED DIELECTRIC SUBSTRATE INTEGRATED FILTER

(71) Applicants: NANTONG UNIVERSITY, Nantong (CN); NANTONG RESEARCH INSTITUTE FOR ADVANCED COMMUNICATION TECHNOLOGIES LTD., Nantong (CN)

(72) Inventors: Kai Xu, Nantong (CN); Mengdan Wang, Zhangye (CN); Jin Shi, Nantong (CN); Rong Cai, Nantong (CN); Wei Zhang, Nantong (CN); Lingyan Zhang, Yongzhou (CN)

(73) Assignees: NANTONG UNIVERSITY, Nantong (CN); NANTONG RESEARCH INST. FOR ADVANCED COMM. & TECH., Nantong (CN)

( * ) Notice: Subject to any disclaimer, the term of this patent is extended or adjusted under 35 U.S.C. 154(b) by 0 days.

(21) Appl. No.: 17/840,228

(22) Filed: Jun. 14, 2022

(30) Foreign Application Priority Data

Aug. 31, 2021 (CN) ..... 202111009507.X

(51) Int. Cl.
*H01P 7/10* (2006.01)
*H01P 1/20* (2006.01)

(52) U.S. Cl.
CPC . *H01P 7/10* (2013.01); *H01P 1/20* (2013.01)

(58) Field of Classification Search
CPC ..... H01P 7/10; H01P 1/20
See application file for complete search history.

(56) References Cited

PUBLICATIONS

CNIPA, Notification of a First Office Action for CN202111009507.X, dated Jan. 28, 2022.
Nantong University et al. (Applicants), Reply to Notification of a First Office Action for CN202111009507.X, dated Mar. 14, 2022.
CNIPA, Notification to grant patent right for invention for CN202111009507.X w/ allowed claims, dated Apr. 22, 2022.

*Primary Examiner* — Samuel S Outten
*Assistant Examiner* — Kimberly E Glenn
(74) *Attorney, Agent, or Firm* — Hemisphere Law, PLLC; Zhigang Ma

(57) ABSTRACT

A balanced-type strip-shaped dielectric substrate integrated filter includes: a high-k dielectric substrate; and first low-k dielectric substrates, second low-k dielectric substrates and metal grounds are symmetrically stacked on upper and lower surfaces of the high-k dielectric substrate. Compared with an existing balanced-type dielectric filter, a high Q-value strip-shaped dielectric substrate integrated resonator with a packageable characteristic which works in $TM_{111}$ mode and employs strip-shaped dielectric blocks with double grooves, combined with air groove structures of upper and lower layers and a packaging substrate is proposed, so that problems that cost is high and self-packaging cannot be realized of the existing balanced-type dielectric filter when being implemented by combining ceramic dielectric with a metal chamber structure can be solved, and thereby a balanced-type strip-shaped dielectric substrate integrated filter with the characteristic of low loss is realized; and meanwhile the filter may have advantages of self-packaging, high integration level and low cost.

1 Claim, 2 Drawing Sheets

BALANCED-TYPE STRIP-SHAPED DIELECTRIC SUBSTRATE INTEGRATED FILTER

TECHNICAL FIELD

The disclosure relates to the field of microwave communications, and more particularly to a balanced-type strip-shaped dielectric substrate integrated filter.

BACKGROUND

In a balanced-type system, compared with a traditional single-ended filter, a balanced-type filter not only can be directly connected with other balanced-type circuits to avoid adding multiple (i.e., more than one) baluns additionally, which is conducive to development trends of miniaturization, high performance and low cost of microwave circuits, but also can improve anti-interference capability, harmonic suppression, reliability, cross-polarization and so on of the system. Therefore, the balanced-type filter has attracted extensive attention. In addition, dielectric resonators have become a research hotspot in recent years because of advantages of high Q-value, high temperature stability and high power capacity. Accordingly, it is of great research value and significance to apply the dielectric resonator to the balanced-type filter to construct a balanced-type dielectric filter with low loss and high frequency-selectivity.

At present, reported balanced-type dielectric filters are mainly realized by two methods. The first method is to place a dielectric block directly inside a metal chamber, but this method cannot design an integratable feeder structure and thus it is difficult to integrate with other planar circuits. The second method is to first mount a dielectric block on a substrate to facilitate the use of an integrated feeder structure, and then place the dielectric block and the feeder structure as a whole inside a metal chamber. The above two methods for realizing the balanced-type dielectric filters mostly use ceramic dielectric materials, so that costs of the filters are relatively high, and moreover the dielectric block and the metal chamber need to be manually mounted, and an integration level of the dielectric resonator needs to be further improved.

SUMMARY

A purpose of the invention is that: in view of the above related art, proposing a balanced-type strip-shaped dielectric substrate integrated filter, to address the problems that cost is high and self-packaging cannot be realized of the balanced-type dielectric filters in the related art when being implemented by combining ceramic dielectric with a metal chamber structure.

Specifically, a technical solution of an embodiment of the invention is as follows.

A balanced-type strip-shaped dielectric substrate integrated filter includes: a high dielectric-constant dielectric substrate; and first low dielectric-constant dielectric substrates, second low dielectric-constant dielectric substrates and metal grounds symmetrically stacked on upper and lower surfaces of the high dielectric-constant dielectric substrate respectively. The high dielectric-constant dielectric substrate includes two strip-shaped dielectric blocks located a core thereof and two fixing strips respectively located at two sides thereof. The two strip-shaped dielectric blocks are arranged in parallel and spaced from each other. A middle portion of each the strip-shaped dielectric block is formed with two parallel rectangular grooves, and a lengthwise direction of each the rectangular groove coincides with a lengthwise direction of the strip-shaped dielectric block. Two ends of each of the two strip-shaped dielectric blocks are respectively connected to the fixing strips located at the two sides of the high dielectric-constant dielectric substrate through dielectric connection bars.

In a rectangular coordination system established with a geometric center of the high dielectric-constant dielectric substrate as an origin, the lengthwise direction of the strip-shaped dielectric block is an x-axis, a y-axis is located in a plane where the high dielectric-constant dielectric substrate is located and is perpendicular to the x-axis, and a z-axis is perpendicular to the plane where the high dielectric-constant dielectric substrate is located.

A central portion of each the first low dielectric-constant dielectric substrate is formed with a cross-shaped air groove, the cross-shaped air groove is arranged along the x-axis and the y-axis, projections of the two strip-shaped dielectric blocks in the z-axis fall within the cross-shaped air groove, and a length of each the strip-shaped dielectric block is greater than a groove width of the cross-shaped air groove. The two strip-shaped dielectric blocks and the first low dielectric-constant dielectric substrates, the second low dielectric-constant dielectric substrates and the metal grounds cooperatively constitute two cavity-type strip-shaped dielectric resonators. A surface of one of the first low dielectric-constant dielectric substrates facing towards the high dielectric-constant dielectric substrate is formed with a pair of balanced-type input terminals extending in the y-axis and a pair of balanced-type output terminals extending in the y-axis. The balanced-type input terminals are configured (i.e., structured and arranged) to input a signal to excite a resonance mode of one of the two cavity-type strip-shaped dielectric resonators and signal-coupling excite the other one of the two cavity-type strip-shaped dielectric resonators and then be output from the balanced-type output terminals.

Beneficial effects: compared with an existing balanced-type dielectric filter, the embodiment of the invention proposes a high Q-value strip-shaped dielectric substrate integrated resonator with a packageable characteristic which works in $TM_{111}$ mode and employs strip-shaped dielectric blocks with double grooves, air groove structures of upper and lower layers and a packaging substrate, so that problems that cost is high and self-packaging cannot be realized of the existing balanced-type dielectric filter when being implemented by combining ceramic dielectric with a metal chamber structure can be solved, and the balanced-type strip-shaped dielectric substrate integrated filter with the characteristic of low loss is realized; and meanwhile the filter may have advantages of self-packaging, high integration level and low cost.

DETAILED DESCRIPTION OF EMBODIMENT

The invention will be further explained below with reference to the accompanying drawings.

Figure 1:
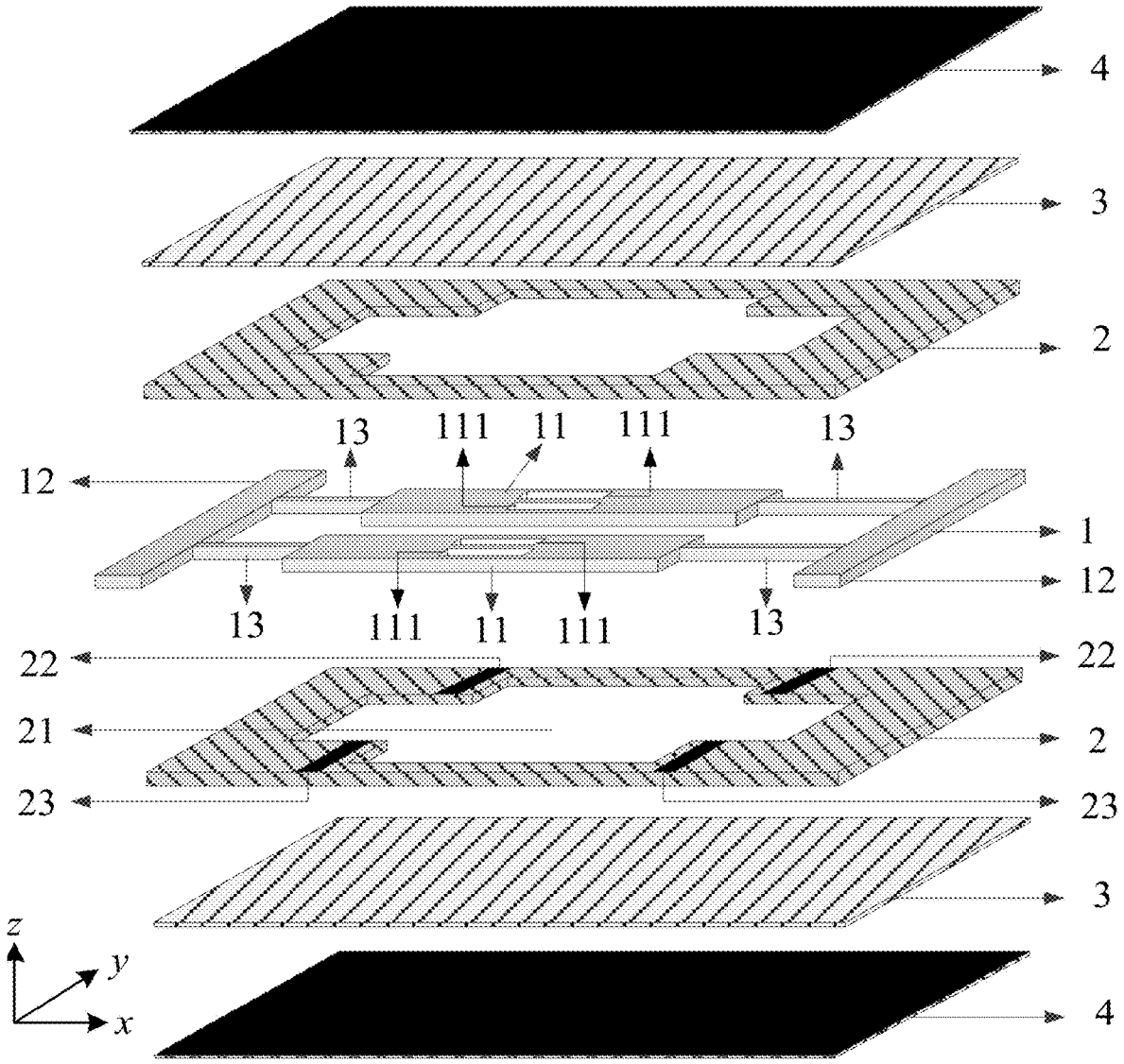
FIG. 1 illustrates a schematic exploded structural view of a balanced-type strip-shaped dielectric substrate integrated filter according to an embodiment of the invention.

As illustrated in FIG. 1, a balanced-type strip-shaped dielectric substrate integrated filter includes: a high dielectric-constant (also referred to as high-k) dielectric substrate 1; and first low dielectric-constant (also referred to as low-k) dielectric substrates 2, second low-k dielectric substrates 3 and metal grounds 4 symmetrically stacked on upper and lower surfaces of the high-k dielectric substrate 1, thereby one of the first low-k dielectric substrates 2, one of the second low-k dielectric substrates 3 and one of the metal grounds 4 are sequentially stacked in that order on a corresponding one of the upper and lower surfaces of the high-k dielectric substrate 1. The high-k dielectric substrate 1 includes two strip-shaped dielectric blocks 11 located at a core thereof and two fixing strips 12 respectively located at two sides thereof. The two strip-shaped dielectric blocks 11 are arranged in parallel and spaced from each other. A middle portion of each of the strip-shaped dielectric blocks 11 is formed with two parallel rectangular grooves 111, and a lengthwise direction of each of the two parallel rectangular grooves 111 coincides with a lengthwise direction of the strip-shaped dielectric block 11. Two ends of each of the two strip-shaped dielectric blocks 11 are respectively connected to the fixing strips 12 through dielectric connection bars 13.

In a rectangular coordination system (also referred to as Cartesian coordinate system) established with a geometric center of the high-k dielectric substrate 1 as an origin, the lengthwise direction of the strip-shaped dielectric block 11 is an x-axis, a y-axis is located in a plane where the high-k dielectric substrate 1 is located and is perpendicular to the x-axis, and a z-axis is perpendicular to the plane where the high-k dielectric substrate 1 is located.

Figure 2:
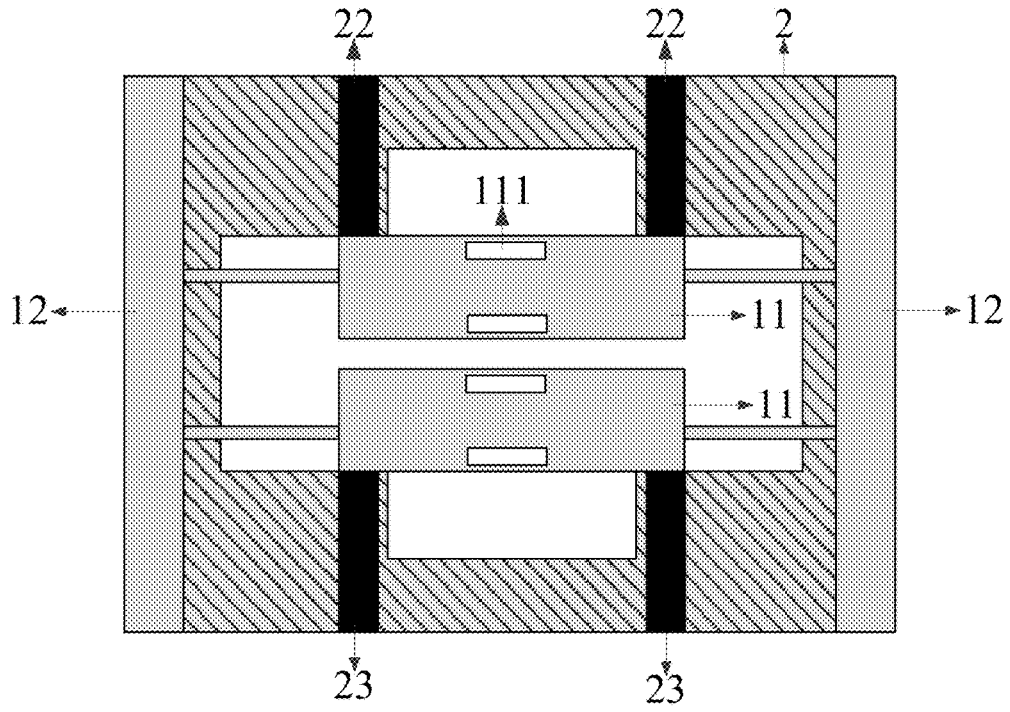
FIG. 2 illustrates a schematic top view of a high dielectric-constant dielectric substrate conforming to a first low dielectric-constant dielectric substrate at the lower layer.

A central portion of each the first low-k dielectric substrate 2 is formed with a cross-shaped air groove 21, the cross-shaped air groove 21 is arranged along the x-axis and the y-axis, projections of the two strip-shaped dielectric blocks 11 in the z-axis direction fall within the cross-shaped air groove 21, and a length of each the strip-shaped dielectric block 11 is greater than a groove width of the cross-shaped air groove 21, as shown in FIG. 2. The two strip-shaped dielectric blocks 11 and the first low-k dielectric substrates 12, the second low-k dielectric substrates 13 and the metal grounds 14 cooperatively constitute two cavity-type strip-shaped dielectric resonators. A surface of one of the first low-k dielectric substrates 11 facing towards the high-k dielectric substrate 1 is formed with a pair of balanced-type input terminals 22 composed of feeder lines extending in the y-axis and a pair of balanced-type output terminals 23 composed of feeder lines extending in the y-axis. A signal is input from the balanced-type input terminals 22, excites a resonance mode of one of the cavity-type strip-shaped dielectric resonators and signal-coupling excites the other one of the cavity-type strip-shaped dielectric resonators, and then is output from the balanced-type output terminals 23.

The cavity-type strip-shaped dielectric resonator of the illustrated embodiment of the invention has two structural features: 1) a main structural portion is a dielectric structure, which has lower conductor loss compared to an integrable metal resonator; and 2) the cross-shaped air groove 21 on the first low-k dielectric substrate 2 further reduces dielectric loss for the substrate integrated resonator. As a result, the strip-shaped dielectric substrate integrated filter equipped with this resonator may have the characteristic of low loss.

In particular, when it is excited through a differential-mode signal, it can excite a $TM_{111}$ mode of the cavity-type strip-shaped dielectric resonator and signal-coupling excite a $TM_{111}$ mode of the other cavity-type strip-shaped dielectric resonator, thereby constituting a differential-mode operating passband with the characteristic of low loss, and due to a mutual coupling between the input and output balanced-type terminals, two zero-points of transmission are generated at edges of the differential-mode operating passband, thus improving the frequency-selectivity. In addition, the etched rectangular grooves in the cavity-type strip-shaped dielectric resonator can effectively suppress high-order modes of the resonator, thereby improving the performance of out-of-band suppression.

When it is excited through a common-mode signal, it can excite a $TM_{211}$ mode of the cavity-type strip-shaped dielectric resonator and signal-coupling excite a $TM_{211}$ mode of the other cavity-type strip-shaped dielectric resonator. However, because the $TM_{211}$ mode operating in the common-mode and the $TM_{111}$ mode operating in the differential-mode are not at the same frequency, the designed balanced-type dielectric filter has good common-mode suppression performance in the range of the differential-mode operating passband.

In addition, the middle portion of each the strip-shaped dielectric block 11 is provided with two parallel rectangular grooves 111, and the lengthwise direction of each of the two parallel rectangular grooves 111 coincides with the lengthwise direction of the strip-shaped dielectric block 11, which can suppress the high-order modes of the resonator and improve the out-of-band suppression.

Figure 3:
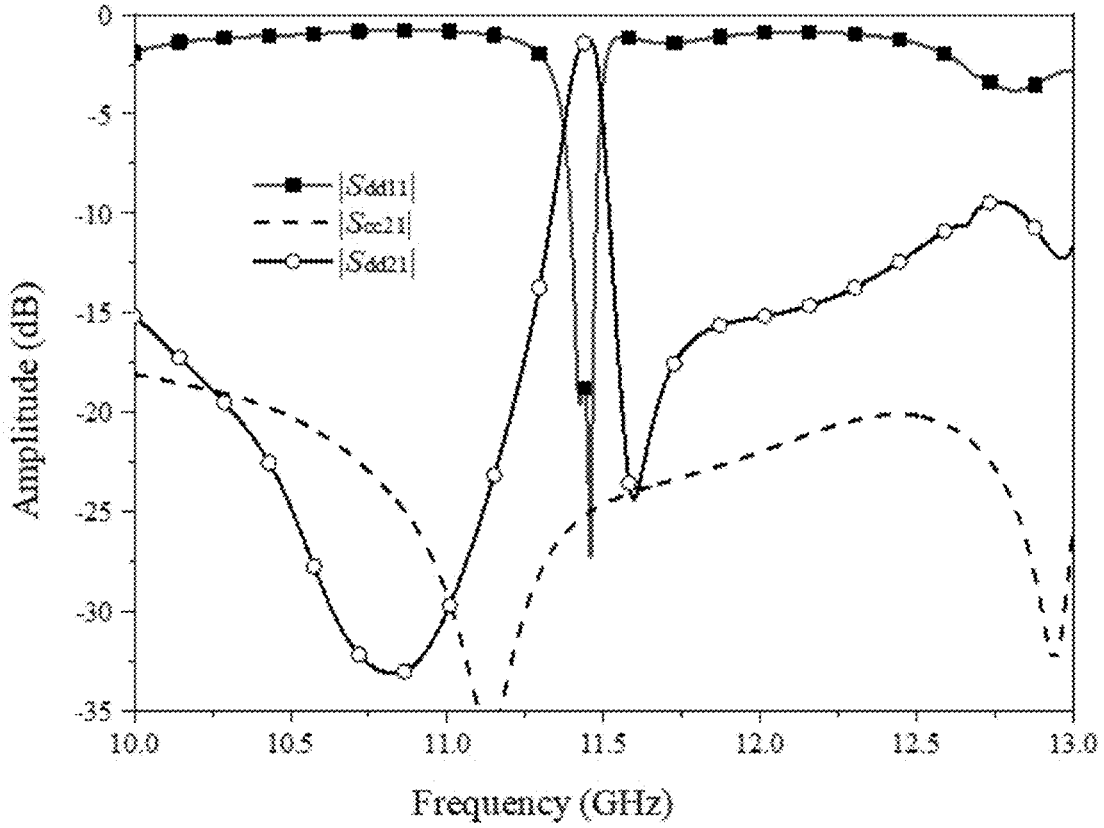
FIG. 3 illustrates a frequency response simulation diagram of the filter according to the embodiment of the invention.

In an illustrated embodiment, each the first low-k dielectric substrate 2 and each the second low-k dielectric substrate 3 are RO4003C substrates with a dielectric-constant of 3.55 and a loss angle of 0.0027 and with respective thicknesses of 0.203 mm and 0.913 mm; and the high-k dielectric substrate 1 is a RO3010 substrate with a dielectric-constant of 10.2, a loss angle of 0.0023 and a thickness of 3.148 mm. A center frequency of the dielectric substrate integrated filter is set as 11.4 GHz, a frequency response simulation diagram is shown in FIG. 3, and the zero-points of transmission on both sides of the differential-mode passband are located at 10.85 GHz and 11.6 GHz respectively. Its 3-dB relative bandwidth is 1%, a minimum insertion loss is only 1.2 dB, and the common-mode suppression in the passband is greater than 20 dB, which can effectively ensure the suppression of common-mode signal in the differential-mode passband. A physical size of the filter is, for example, 50 mm×40 mm×5.414 mm.

The above description is only a preferred embodiment of the invention, and it should be noted that for those skilled in the art, several improvements and modifications can be made without departing from the principle of the invention can be made, and these improvements and modifications should also be regarded as the protection scope of the invention.

What is claimed is:

1. A balanced-type strip-shaped dielectric substrate integrated filter, comprising:

a high dielectric-constant dielectric substrate; and first low dielectric-constant dielectric substrates, second low dielectric-constant dielectric substrates and metal grounds, symmetrically stacked on upper and lower surfaces of the high dielectric-constant dielectric substrate respectively;

wherein the high dielectric-constant dielectric substrate comprises two strip-shaped dielectric blocks located at a core of the high dielectric-constant dielectric substrate and two fixing strips respectively located at two sides of the high dielectric-constant dielectric substrate, the two strip-shaped dielectric blocks are arranged in parallel and spaced from each other, a middle portion of each the strip-shaped dielectric block is formed with two parallel rectangular grooves, a lengthwise direction of each the rectangular groove coincides with a lengthwise direction of the strip-shaped dielectric block, and two ends of each of the two strip-shaped dielectric blocks are respectively connected to the fixing strips located at the two sides of the high dielectric-constant dielectric substrate through dielectric connection bars;

wherein in a rectangular coordinate system established with a geometric center of the high dielectric-constant dielectric substrate as an origin, the lengthwise direction of the strip-shaped dielectric block is an x-axis, a y-axis is located in a plane where the high dielectric-constant dielectric substrate is located and is perpendicular to the x-axis, and a z-axis is perpendicular to the plane where the high dielectric-constant dielectric substrate is located;

wherein a central portion of each of the first low dielectric-constant dielectric substrates is formed with a cross-shaped air groove, the cross-shaped air groove is arranged along the x-axis and the y-axis, projections of the two strip-shaped dielectric blocks in a direction of the z-axis fall within the cross-shaped air groove, and a length of each of the two strip-shaped dielectric blocks is greater than a groove width of the cross-shaped air groove; the two strip-shaped dielectric blocks and the first low dielectric-constant dielectric substrates, the second low dielectric-constant dielectric substrates and the metal grounds cooperatively constitute two cavity-type strip-shaped dielectric resonators, a surface of one of the first low dielectric-constant dielectric substrates facing towards the high dielectric-constant dielectric substrate is provided with a pair of balanced-type input terminals extending in the y-axis and a pair of balanced-type output terminals extending in the y-axis, the balanced-type input terminals are configured to input a signal to excite a resonance mode of one of the two cavity-type strip-shaped dielectric resonators and signal-coupling excite the other one of the two cavity-type strip-shaped dielectric resonators and then be output from the balanced-type output terminals.

* * * * *